United States Patent [19]

Ward et al.

[11] 4,199,871

[45] Apr. 29, 1980

[54] AUTOMATIC HOLD SPEED SETTING CONTROL METHOD AND APPARATUS USED WITH A CONTINUOUS AUTOMATIC WOOD VENEER DRYER CONVEYOR SPEED CONTROL MONITORING COMPUTER APPARATUS

[75] Inventors: Donald D. Ward, Sumner; Arthur W. Emigh, Jr., Redmond, both of Wash.

[73] Assignee: Ward Systems, Inc., Sumner, Wash.

[21] Appl. No.: 880,579

[22] Filed: Feb. 23, 1978

[51] Int. Cl.[2] ..... F26B 3/00

[52] U.S. Cl. ..... 34/25; 34/52

[58] Field of Search ..... 34/43, 52, 25; 307/118; 324/65

[56] References Cited

U.S. PATENT DOCUMENTS

| | | | |
|---|---|---|---|
| 2,942,352 | 6/1960 | Eicken-Estienne | 34/52 |
| 3,395,459 | 8/1968 | Taylor | 34/52 |
| 3,732,435 | 5/1973 | Strandberg, Jr. et al. | 34/52 |
| 3,961,425 | 6/1976 | Swanson et al. | 34/52 |

*Primary Examiner*—Larry I. Schwartz

*Attorney, Agent, or Firm*—Mattern, Deits, Kessler & Moravan

[57] ABSTRACT

An automatic hold speed setting control method and apparatus is used in conjunction with the method and apparatus of a continuous wood veneer dryer conveyor speed control monitoring computer apparatus. This automatic hold speed setting control apparatus is triggered when electrical signals cease, that were being generated by a tachometer monitoring the conveyor speed of the continuous wood veneer dryer. It then allows the automatic speed control monitoring computer apparatus to remain on the line possibly throughout two minutes to determine whether or not the shutdown of the dryer conveyor is perhaps only temporary. If not temporary, this automatic hold speed setting control apparatus becomes effective in disconnecting the automatic speed control monitoring computer apparatus and in holding a conveyor speed setting established just before the dryer conveyor shutdown. When the conveyor operates again, the electrical signals again being generated by the tachometer, are delayed in their effectiveness for a period representing the discharge of a load of wood veneers being dried, and often an additional limited extended period. Thereafter, these electrical signals become effective as before within the circuitry of the automatic wood veneer dryer conveyor speed control monitoring computer apparatus.

7 Claims, 10 Drawing Figures

AUTOMATIC HOLD SPEED SETTING CONTROL METHOD AND APPARATUS USED WITH A CONTINUOUS AUTOMATIC WOOD VENEER DRYER CONVEYOR SPEED CONTROL MONITORING COMPUTER APPARATUS

BACKGROUND OF THE INVENTION

There are many drying processes wherein the overall effectiveness of the drying processes must be monitored and then controlled to obtain the most economical production results. Such monitoring and control in the past have been undertaken by skilled personnel manipulating controls based on their direct product observations and/or on their observations of the readings of instruments. Also such monitoring has been undertaken by utilizing equipment such as illustrated and described in U.S. Pat. No. 3,241,249, wherein the speeds of conveyor-type dryers of wood veneer sheets are controlled, being changed automatically as necessary, at times to reach the maximum production of wood veneers having a suitable dryness. In more recent times, other monitoring and control equipment has been developed. However, the reliance on product observations made directly and/or made via instrumentation during a production period immediately following an extended shut down period of a conveyor loaded with products within a dryer, to again control the speed and/or temperature of a conveyor will cause confusion and production problems, because of the presence of the overdried products leaving the dryer after the shut down of the conveyor. Therefore, especially when automatic speed control apparatus is being relied upon, there should be a way to avoid such reliance, until the products being dried are again traveling through the dryer without being stopped on a shutdown conveyor. This invention serves this need by providing a shutdown triggered hold speed control method and apparatus for use with an automatic speed control apparatus regulating continuous drying process equipment.

SUMMARY OF THE INVENTION

When automatic speed control apparatus is employed in conjunction with product drying equipment carrying products on conveyors, if the control of the conveyor speed within the dryer, is based on various data sources continuously sampled and utilized to monitor the speeds and/or temperatures, then if the data sources include the degree of product dryness of products leaving the conveyor, a control problem arises when the conveyor stops and the products in the conveyor become overly dried. To overcome this problem, a hold speed setting control apparatus is provided for addition to or inclusion in automatic speed control monitoring apparatus, often using computer logic components, to temporarily eliminate the direct control of the automatic speed control apparatus, which otherwise continues to function, until a time passes essentially representative of the conveyor length travel time through the conveyor carrying the overly dried products.

In an embodiment of a hold speed setting control apparatus provided for addition to or inclusion in automatic speed control monitoring apparatus of a wood veneer conveyor drier, the stopping of electrical signals from a tachometer indicating the speed of the drier conveyor, when the conveyor stops, are observed by this hold speed setting control apparatus. It has a two minute timer which keeps the automatic speed control monitoring apparatus ready to continue its operation receiving many signals which are logically computed to determine an effective dryer speed to keep an economical percentage of veneers within a selected retained moisture content range. If the two minutes are exceeded, the hold speed setting control apparatus operates to be ready to keep the wood veneer dryer operating at the speed set, before the conveyor stopped. When the conveyor resumes speed again, this speed is held for at least one dryer length of the conveyor. Then the hold speed setting control apparatus becomes inactive and the automatic speed control monitoring apparatus becomes operable and so remains, until the conveyor is shut down again inadvertently overdrying the wood veneers remaining on the conveyor within the dryer. If the hold speed setting control apparatus were not utilized, the overly dry wood veneers, when analyzed by moisture detectors, would create a dryness computer logic input resulting in an unwanted higher speed of the dryer conveyor, which soon would be too high a speed when normally wet wood veneers again are coming through the dryer, thereby resulting in a very large percentage of veneers needing redrying.

DESCRIPTION OF THE DRAWINGS

Introduction to the Drawings

FIG. 1 is a flow chart type diagram of functional blocks of a conveyor hold speed setting control apparatus triggered upon the shutdown of a dryer conveyor, in reference to the functions of an automatic speed control monitoring computer apparatus, which after an initial time period, after a dryer conveyor stops, is placed in a hold status by this conveyor hold speed setting control apparatus, also showing existing equipment, such as the tachometer on the drive motor, to indicate where various signals are created which ultimately are directed to the automatic speed control monitoring computer apparatus;

FIG. 2 is a flow chart type diagram of a plan view of a wood veneer dryer in a plywood mill to illustrate where the dryer conveyor shutdown triggered hold speed setting control apparatus, designated as hold speed control is preferably located adjacent to or within the computer serving as the principal component of the automatic speed control monitoring apparatus;

FIG. 3 is a more detailed functional block diagram of how the dryer conveyor shutdown triggered hold speed setting control apparatus is interrelated to the automatic speed control monitoring computer apparatus used in the plywood mill in controlling the speed of the wood veneer dryer conveyor;

FIG. 4 is a schematic circuit diagram, showing how the analog type signals created by a tachometer, which indicates the speed of the conveyor variable speed drive motor and hence the speed of the wood veneer dryer conveyor, often referred to as dryer speed, are being monitored by the dryer conveyor hold speed setting control apparatus, and more particularly these signals are processed in a voltage to frequency converter in which they are calibrated for frequency, amplified and filtered, then converted into a series of digital type signals in a voltage controlled oscillator, which are thereafter shaped into a specific spaced pulse in a pulse generator and displayed via a light emitting diode, and then utilized for the purpose illustrated in FIG. 5;

FIG. 5 is a schematic circuit diagram illustrating how the specific spaced pulse, originally derived from the tachometer signal indicating the dryer conveyors operation, as shown in FIG. 4, is then used to indicate when a row of wood veneer is leaving the dryer, by employing a decade counter, and another pulse generator, and thereafter this modified spaced signal indicating a row of wood veneer leaving the dryer is received by a dryer length timer set to receive a designated number of these row count pulses, which indicates the number of rows of veneer occupying a length of the conveyor, which is in the dryer at any one moment of time, i.e. the length of the dryer, and also illustrated is the dryer stopped timer which is triggered by the failure of the tachometer analog type signal to start a two minute wait and see time period, which if exceeded, sends on power from an outside power source to ultimately hold the last dryer speed set for the dry just before shutdown;

FIG. 6 is a schematic circuit diagram indicating the interrelated switching functions centering on the establishment and discontinuance of the hold speed setting period, showing the automatic functioning of the hold speed setting control apparatus in conjunction with the automatic speed control monitoring computer apparatus, and indicating how at the outset of a first run of a new grouping of wood veneers, an operator's initial operation of the automatic switch likewise establishes the hold speed setting period, and moreover how an operator may at any time operate a manual switch to override the functions of both the automatic speed control monitoring computer apparatus and also the hold speed setting control apparatus;

FIG. 7 is a functional block diagram showing a sample and hold type motor control which is receiving changeable automatic speed control signals from the automatic speed control monitoring computer apparatus, i.e. from its automatic speed controller circuitry, and passing the signals on to the pilot motor, after amplification and passage through a motor control circuit, indicating during normal operations how the tachometer signals, i.e. tachometer feed back signal, is compared to the desired dryer speed control signal to obtain the desired dryer speed, and also illustrating when the dryer conveyor stops how the variable speed drive motor power interlock removes plant line power from the pilot motor thur preventing incorrect positioning of the pilot motor, and also showing how after the two minute period, and during the dryer length time period, when the dryer conveyor is again running how the then generated hold logic signal disconnects the motor control circuit to hold or to maintain the dryer speed setting previously established prior to shutdown;

FIG. 8 is schematic electrical diagram of components in the sample and hold motor control, together with the pilot motor, as first illustrated in FIG. 7, indicating also the control to the variable speed drive of the dryer conveyor; and FIGS. 9 and 10, in functional block diagrams illustrate how various selected embodiments of other components may be selected in lieu of others already shown to acquire the same operational control objectives, with FIG. 9 illustrating how the speed of the dryer conveyor is sensed by a pulse generator or a digital type tachometer, rather than an AC or DC tachometer, and with FIG. 10, illustrating how the speed of the dryer conveyor is sensed by a switch contact closure or conveyor sprocket type switch, either one being driven by the rolls or gears of the dryer conveyor.

DESCRIPTION OF PREFERRED EMBODIMENTS

Figure 1:
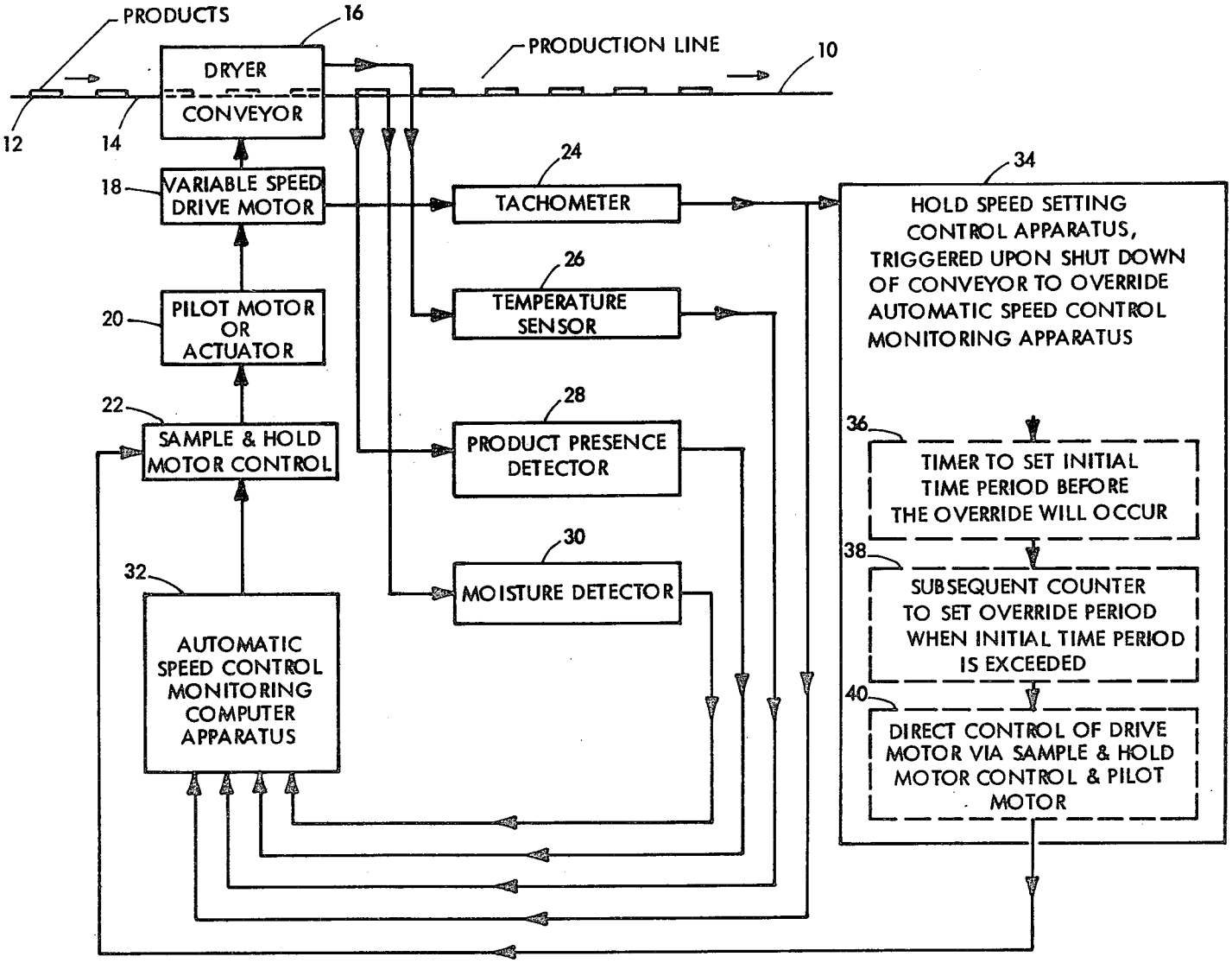
FIGS. 1, 2, 3, 7 and 9 are flow chart type and functional block views illustrating schematically the arrangements of equipment with indicating data to explain, broadly, where and how the dryer conveyor shutdown triggered hold speed setting control apparatus is used, centering primarily on holding the dryer conveyor speed.

Introduction to an Illustrated Preferred Embodiment Used in a Plywood Mill

In many plywood mills, the speed of the wood veneer dryer conveyor is generally relied upon as the most effective way of controlling the drying rate. Therefore the illustrated embodiments of FIGS. 1 through 9, pertain to a hold speed setting control apparatus triggered upon the shut down of a wood veneer dryer, beyond an initial time period to thereafter hold a dryer speed established by an automatic speed control monitoring computer apparatus just before the dryer conveyor shutdown, for a definite preselected period of time, after the conveyor is started again.

In a plywood mill the wood veneers passing through the wood veneer dryer occasionally jam up while trying to travel through the dryer on a conveyor. Oftentimes, the dryer conveyor is stopped for a period of time, while the wood veneer jam is cleared away. Upon starting again the wood veneer leaving the dryer on the conveyor is overly dry because of the long stay within the dryer as the wood veneer jam was cleared. When the otherwise continuous operation of the wood veneer dryer is being automatically controlled by a speed control monitoring computer apparatus, one of the many data sources considered within the computer is the moisture content of the wood veneers leaving the dryer. Therefore after a shutdown, beyond a short initial time, the wood veneers confined within the shutdown conveyor become overly dry. Then upon starting the conveyor again, these overly dry wood veneers, when scanned by the moisture detectors, present misleading data to the speed control monitoring computer apparatus. If this monitoring computer were permitted to be active, during this overly dry detection period, in setting the dryer conveyor speed, then the speed would increase too much, and the follow on wood veneers passing through the higher speed dryer would not be sufficiently dried. Therefore, to avoid this unwanted speed up, although the computer still will analyze the overly dry wood veneer, the computer, with reference to controlling the speed of the dryer drive motor, is prevented from doing so, by this embodiment of the dryer conveyor shutdown triggered dryer hold speed setting control apparatus. The prevention or hold period is adjustable and generally is at least as long as the time taken to move out of the dryer the conveyor length on which the overly dried veneers were being supported. This period corresponds to the computer time wherein the memory of the computer has taken in and disposed of bad control data based on the recordings of moisture detectors sensing the departing overly dried wood veneers, previously left on the dryer conveyor within the dryer during the shutdown. During the hold period, the hold speed setting control apparatus assures the dryer speed remains at the speed set by the automatic speed setting control monitoring computer apparatus just prior to the shutdown of the dryer conveyor. Therefore there will not be a possibility of the dryer running too fast, because of detections of overly dry wood veneers, when once again wood veneers are moving through the dryer without being delayed enroute.

The Overall Relationships of the Wood Veneer Dryer and its Conveyor, Variable Speed Drive Motor, Pilot Motor, Tachometer and a Dryer Temperature Sensor, a Product Presence Detector, a Product Moisture Detector, and the Automatic Speed Control Monitoring Computer Apparatus, the Sample Hold Motor Control, and the Hold Speed Setting Control Apparatus Triggered Into Operation Upon the Shutdown of the Dryer Conveyor In FIG. 1, the interrelationship of the many items of equipment is schematically illustrated in a flow chart type diagram of functional blocks indicating how controlling data and power signals are generally transmitted by electrical and electronic circuits and components. On a production line 10, products 12, are being moved on a conveyor 14 through a dryer 16, driven by a variable speed drive motor 18, having a speed adjustment pilot motor 20 or actuator 20, directed in turn by a sample-hold motor control 22. During normal operations of continuous movement of products 12 through the dryer 16, a tachometer 24 is creating electrical signals to indicate the speed of the drive motor 18, and thereby indicating the speed of the conveyor 14, passing through the dryer 16, carrying the products 12 being dried. Also a temperature sensor 26 is transmitting temperature data pertaining to the temperature within the dryer 16. In addition a product presence detector 28 is transmitting information indicating a product count of those products 12, often in transverse rows, leaving the dryer 16. Moreover, a moisture detector 30 is sending data to relate what moisture content the products 12 have upon leaving the dryer 16.

All of this data from the tachometer 24, temperature sensor 26, product presence detector 28, and moisture detector 30, is received and used in an automatic speed control monitoring computer apparatus 32. The data is utilized and compared with desired often preset control data stored within memories and other components of this automatic speed control monitoring computer apparatus 32 which has been and is being used to control such dryer operations, wherein products 12 are being conveyed through the dryer 16. In this FIG. 1, the sample-hold motor control 22 is illustrated as receiving control data signals and power from the automatic speed control apparatus 32. Then in turn the pilot motor 20 as necessary is operated to change the speed of the variable speed drive motor 18.

However, there are times when the conveyor 14 stops or is stopped and on it are products 12 being dried, which then stay too long within the dryer 16 and become overly dry. If this occurs, and if the automatic speed control is permitted to operate fully, the overly dry wood veneers, when sensed by the moisture detector, create data used in the automatic speed control monitoring computer apparatus 32, which indicates the variable speed drive motor should be set at a higher speed. The control time lag involved, thereafter, causes several rows of wood veneers to be passed through the dryer too fast and they emerge too wet causing their necessary redry.

To avoid this unwanted operational result following a wood veneer dryer shutdown, beyond a short wait and see period, a hold speed setting control apparatus 34 is now provided as illustrated in FIG. 1. It is triggered upon the shutdown of the wood veneer, when the electrical signals and/or energy stops, which was previously coming from the tachometer. At this moment a timer 36 is actuated for a set period, generally of two minutes. If the dryer conveyor 14 starts again within the two minutes, the automatic speed control monitoring computer apparatus 32 continues its effective signaling and power transmission to the sample and hold motor control 22. If, however, the two minutes are exceeded, then the hold speed setting control apparatus 34 becomes effective and keeps the last speed setting, occurring just before the conveyor 14 shutdown, as a constantly held speed setting throughout a definite period of time set within the inner time setting components 38 of the hold speed setting control apparatus 34, through direct circuit controls 40 interconnected with the sample-hold motor control 22.

Preferable Location of Hold Speed Setting Control Apparatus in a Plywood Mill

Figure 2:
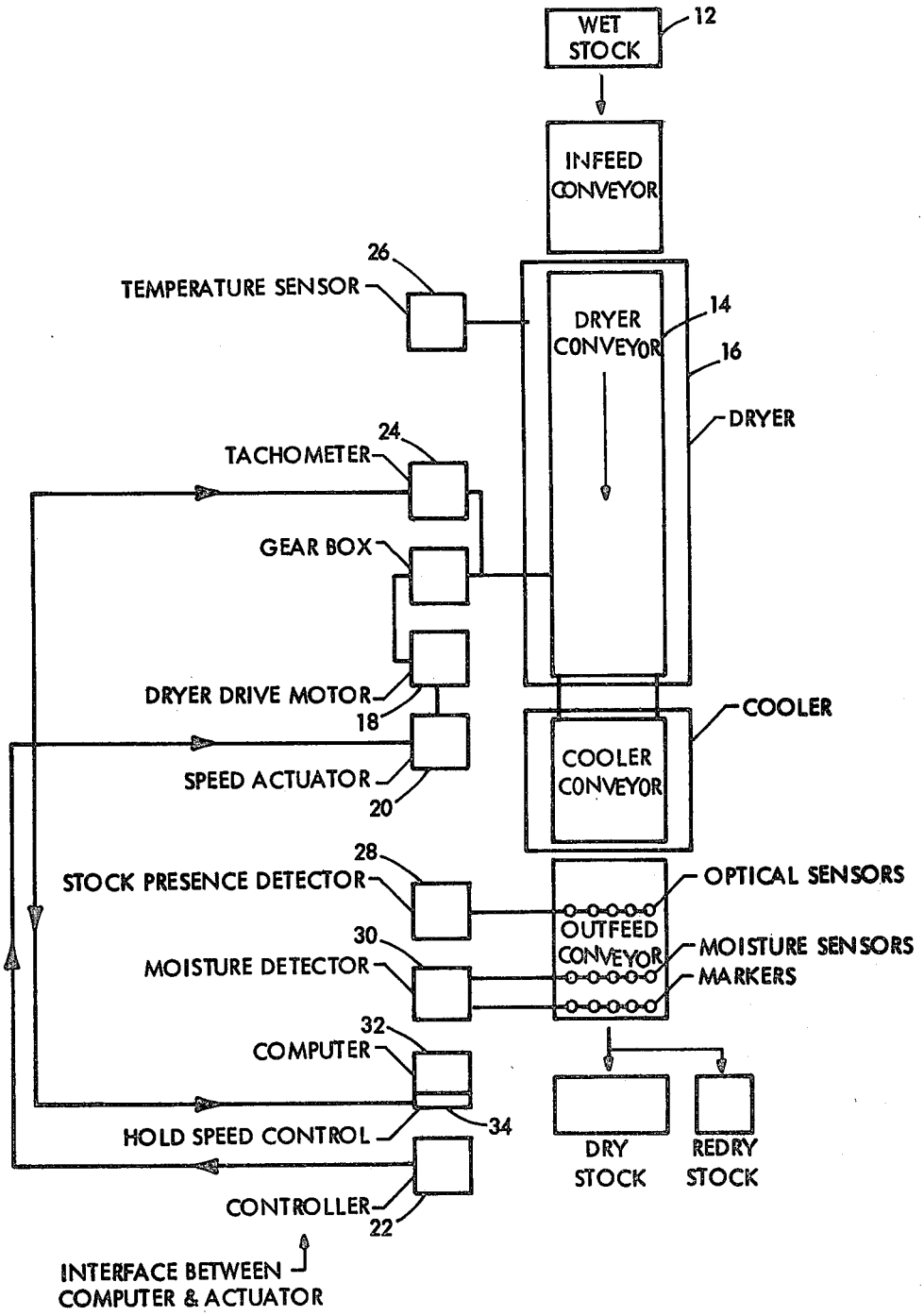

In FIG. 2, a schematic plan view of a plywood mill, in the vicinity of the wood veneer dryer 16, is illustrated to indicate the preferable location of the hold speed setting control apparatus 34, which is designated as the hold speed control in this figure.

Figure 3:
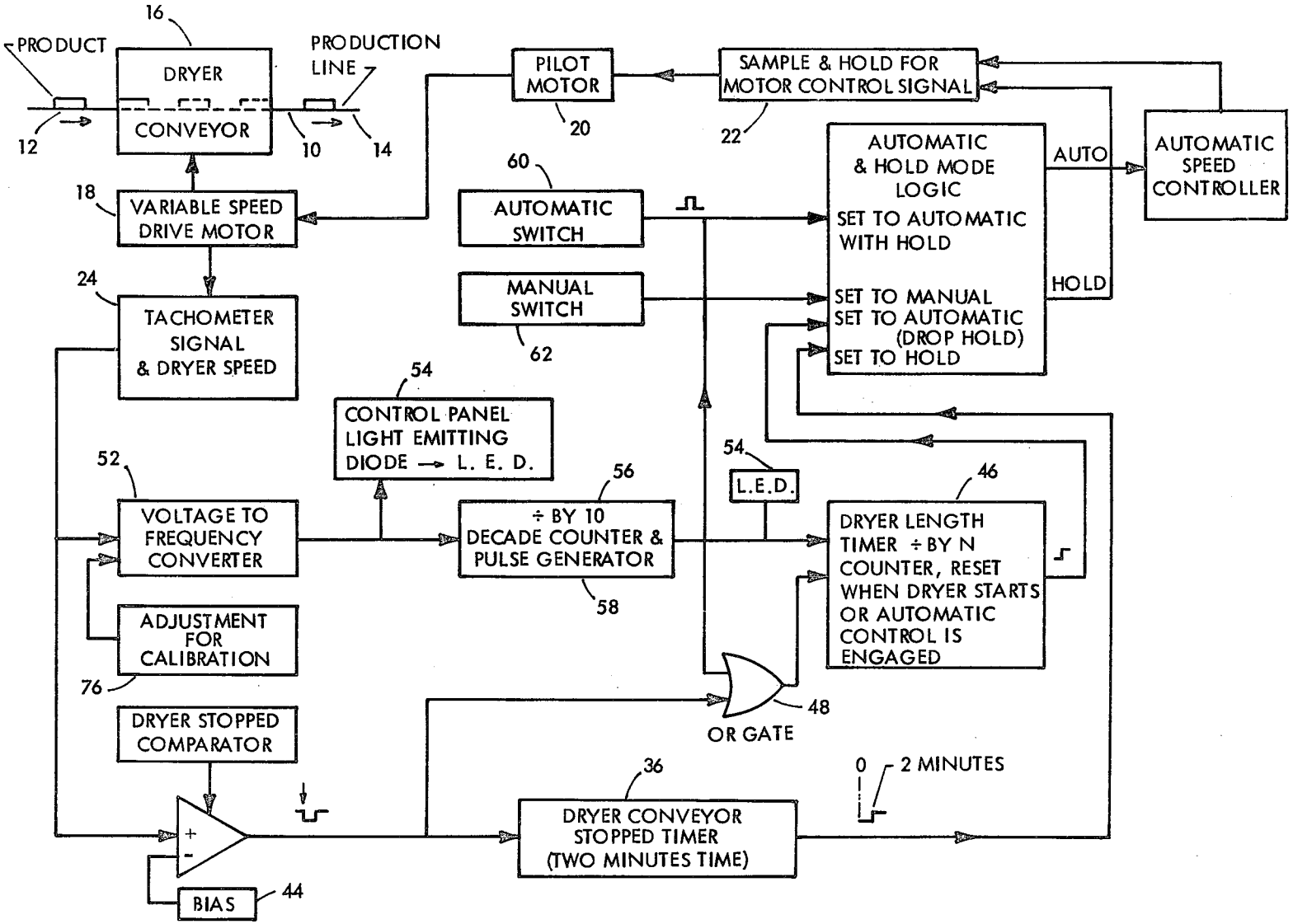

The Schematic Arrangement of the Interrelated Wood Veneer Drying Equipment, the Automatic Speed Control Monitoring Computer Apparatus and Hold Speed Setting Control Apparatus In FIG. 3, continuing the overall presentation of the interrelationship started in FIG. 1, a more detailed functional block diagram is illustrated of the interrelated wood veneer drying equipment 16, the automatic speed control monitoring computer apparatus 32 and the hold speed setting control apparatus 34. To depict further the function of the hold speed setting control apparatus 34, when the dryer conveyor 14 stops, as its variable speed drive motor 18 is turned off or loses its power supply, the tachometer 24 stopping is detected by a dryer stopped logic comparitor 42, or amplifier, subject to a bias outside power source 44. This power source 44 causes the operation of a dryer conveyor stopped timer 46, generally set for two minutes. If the conveyor 14 starts before the possible two minutes expire, then the role of the hold speed setting control apparatus 34 ends, and the operations of the automatic speed control monitoring computer apparatus 32 continue on without interruption.

If, however, the shutdown of the dryer conveyor 14 exceeds the two minutes, the outside bias power source 44 becomes effective through the dryer conveyor stopped timer 46 to set the hold of the dryer conveyor speed equalling the last dryer conveyor speed determined, just before the shutdown, by the automatic speed control monitoring computer apparatus 32. Also this outside bias power source 44, passes through the OR-gate 48 to reset the dryer length timer 50 resetting it to zero.

Upon the starting of the dryer conveyor 14, the tachometer 24 signals and energy again reach the voltage to frequency converter 52 which is inclusive of a voltage controlled oscillator with a calibration adjustment to create a signal pulse observed at a control panel via a light emitting diode, 54 known as L.E.D. Thereafter a decade counter 56 and a pulse generator 58, create a spaced pulse, indicating a row of wood veneer products 12, which is observed at another L.E.D. 54. Thereafter, these spaced pulses, activate the dryer length timer 50 and run it to a preselected time. This time is determined in reference to the spaced pulses, indicating each row of wood veneer products 12, so the number of these pulses received by this timer are set to equal or exceed the number of actual rows of wood veneer, which can occupy the dryer 16 at any point in the time of its operations. In this way, the holding of the dryer speed will be for a time sufficient to clear out of the dryer, the overly dried wood veneers 12, which had been supported on the conveyor 14 within the dryer 16 during the shutdown.

As indicated schematically in this FIG. 3, within the block, noted as automatic and hold mode logic, the set to hold keeps the hold speed, then after the dryer length timer 50 completes its cycle, the automatic logic is returned to set to automatic. The separate automatic switch 60 is often used during the start up of a new drying series of different wood veneers, and a hold period is thereby also started keeping the dryer conveyor at a speed which is initially preset. At all times, if an operator so desires, the manual switch 62 may be depressed and then all the control aspects of the dryer 16 are manually undertaken.

As noted schematically in FIG. 3, when the hold mode is established, the automatic speed control 64, via the sample and hold motor control 22, keeps the pilot motor 20, i.e. actuator 20, essentially inactive but on line, so no change occurs in the variable speed drive motor 18. In contrast, when the automatic mode is reestablished the automatic speed control 64, via the sample and hold motor control 68 and via the sampling function, automatically adjusts as necessary, the pilot motor 20, i.e. actuator 20, and the variable speed drive motor is increased or decreased in speed depending on the power signal received.

Figure 4:
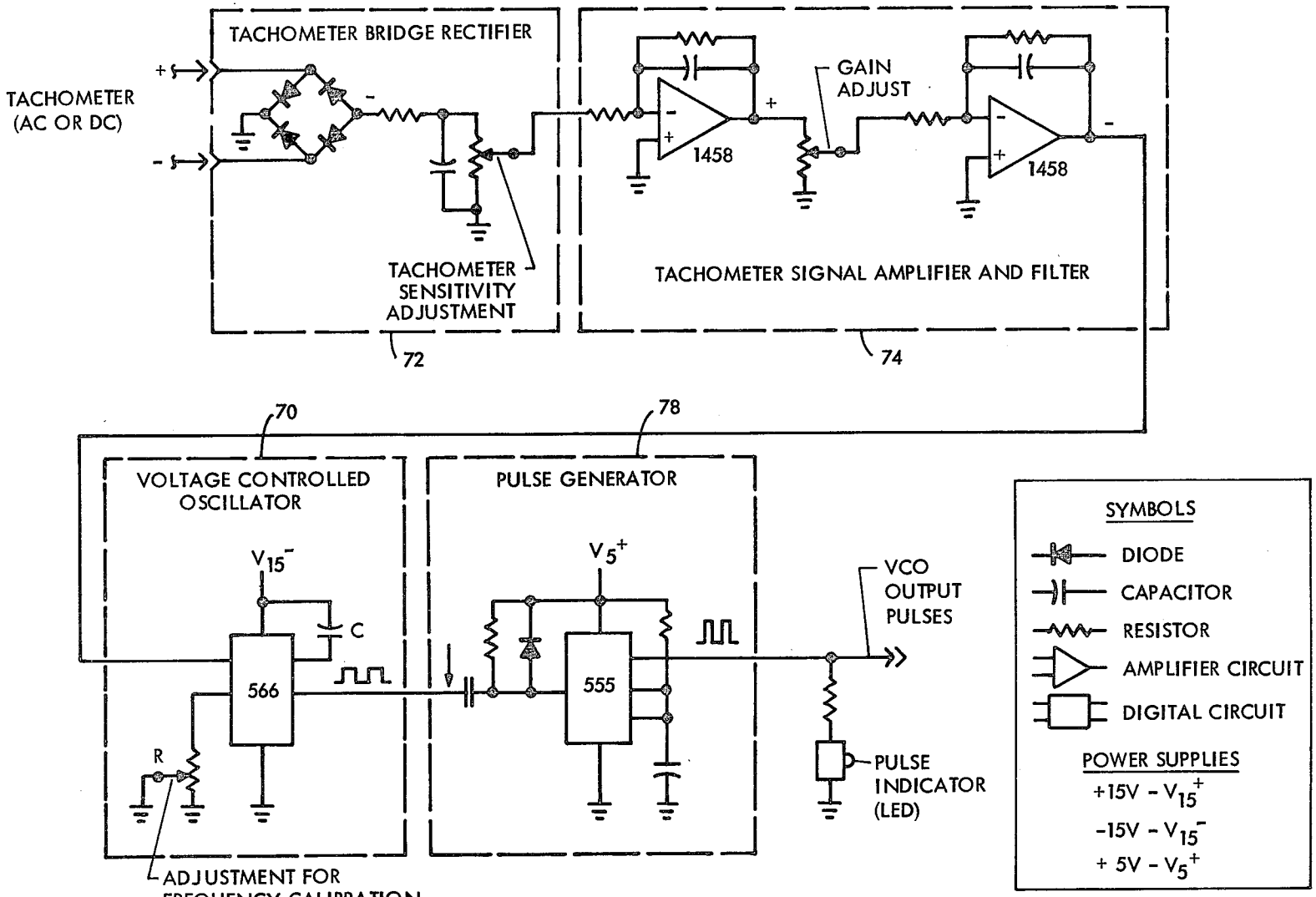
FIG. 4, 5, 6 and 8 are schematic circuit diagrams illustrating embodiments of circuitry and electrical components utilized in the dry conveyor shutdown triggered hold speed setting control apparatus used in conjunction wih a wood veneer dryer conveyor in a plywood mill, with circuit leads going and coming from other components, used previously in an automatic speed control monitoring computer apparatus being so indicated.

Introduction to Symbols and Codes Used Throughout the Schematic Circuit Drawings In FIG. 4, and in reference to those figures to follow, refer to the symbols and code system shown in FIG. 4, which are pertinent to all the schematic circuit diagrams. Also, in respect to illustrating amplifiers, and other components, there are noted inside their symbol boundaries, their industry standard identification numerals, such as 1458, indicating the standard catalog number for this selected amplifier. These standard components, so identified by catalog numbers, also often have on their exterior indicia, numbering their many respective terminals. These indicia or terminal numbers, to avoid confusion, are not shown on these schematic circuit drawings. The relative locations of the terminal hookups are however, indicated on the drawings. The manufacturers' specifications serve to give instructions for making the proper selection of the respective circuit terminals to acquire the operational advantages of one or more of the internal circuits of the particular industry standard component.

Voltage to Frequency Converter, Inclusive of a Voltage Controlled Oscillator, for Generating a Product Row Count Signal The voltage to frequency converter 52, which includes a voltage controlled oscillator 70, generates a product row count signal, i.e. a wood veneer row count signal, as illustrated in the schematic circuit diagram of FIG. 4. This voltage to frequency converter 52 produces a series of uniform pulses at a frequency proportional to the speed of the dryer conveyor. Included, is a dryer conveyor tachometer bridge rectifier 72, a tachometer amplifier and filter combination 74, a voltage controlled oscillator 70, designated by the letters VCO, with an adjustment for frequency calibrator 76, and a pulse generator 78 to provide a pulsed output logic signal. The pulsed output is visually displayed on a light emitting diode designated by the letters LED, pulse indicator, and counted in the dryer length timer shown in FIG. 5.

More specifically regarding the tachometer bridge rectifier, a two wire AC or DC type tachometer signal is conditioned, by rectification and filtering when it comes from an AC type tachometer, and filtering alone is undertaken of the DC type tachometer signal. A tachometer signal sensitivity adjustment is provided to enable standardization within this dryer speed control system.

More specifically regarding the tachometer signal amplifier and filter, the sensitivity adjusted tachometer signal is amplified and filtered in a 1458 type operational amplifier and gain adjusted by a trim potentiometer, for compatibility with the VCO circuit.

More specifically regarding the VCO circuit, a 566 type VCO integrated circuit is utilized to convert the tachometer analog signal to a square wave signal having a frequency which is proportional to the input signal. An external capacitor, and the trimpotentiometer provide the frequency determining network and establishes the center operating frequency of the VCO.

More specifically regarding the pulse generator circuit, a 555 type integrated circuit is configured, i.e. externally connected, as a mono-stable multivibrator. This pulse generator is triggered on each high to low transition of the input signal from the VCO. The output pulse frequency follows the VCO input frequency; however the output pulse width is made uniform over the range of operating frequencies.

Figure 5:
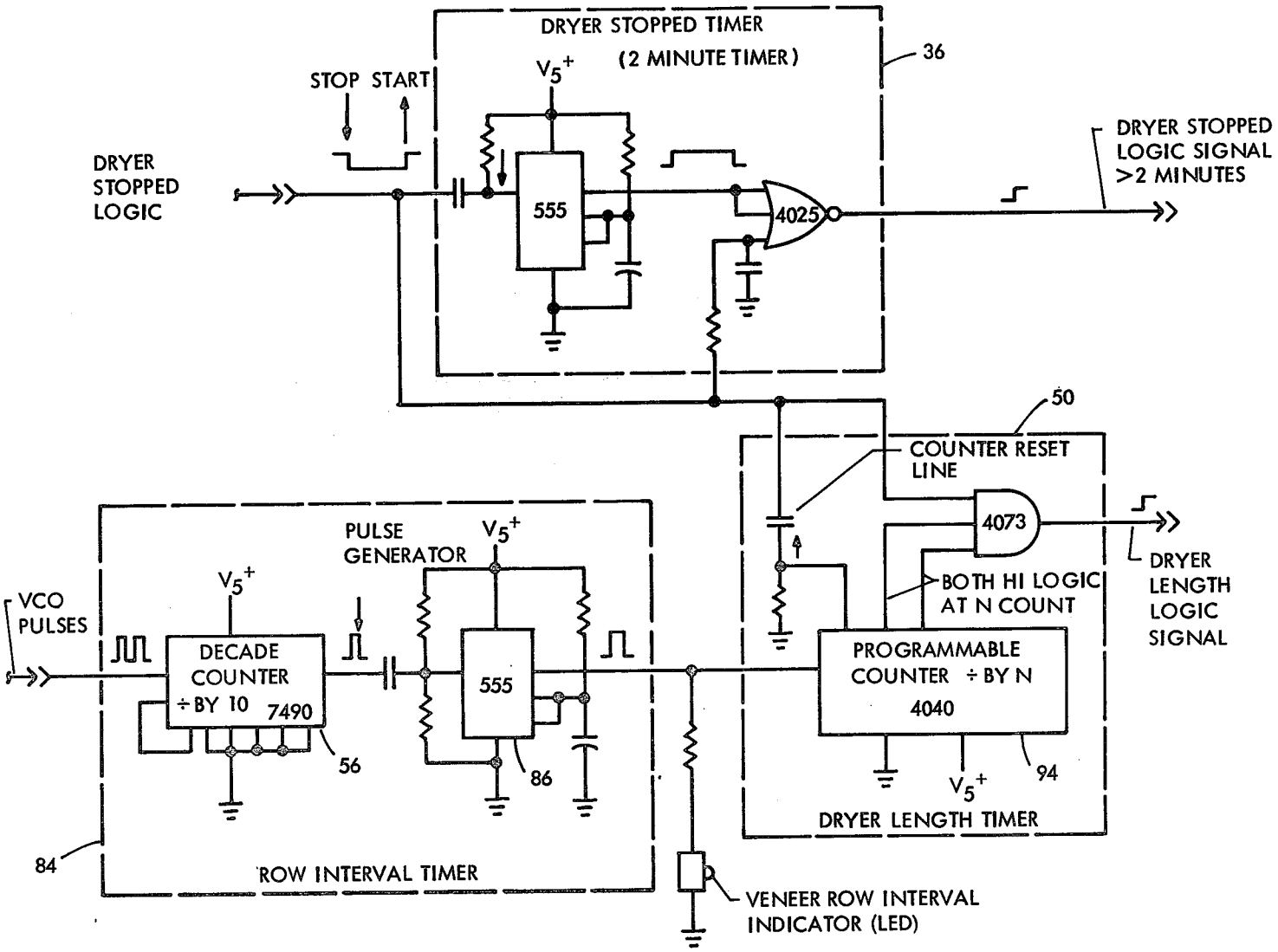

Various Circuits and Components Determining a Preselected Dryer Stop Timing Period, to be Necessarily Exceeded, to Thereafter Generate a Hold Speed Signal, and Thereafter also Determining a Dryer Length Timing Period, to be Exceeded, Before Releasing the Hold Speed Setting and Returning the Speed Setting to the Determination of the Automatic Speed Control The dryer stopped timer 46 and necessary control logic to accomplish the hold function are shown in FIG. 5, including also dryer length timer 50 and a product row interval timer or indicator 64. More specifically regarding this dryer stopped timer 46 receives a logic signal from the dryer conveyor tachometer 24 indicating when the dryer 16 is stopped or running. If stopped, the dryer stopped logic signal changes from a high to low level state and triggers off the 555 type timer, which is connected in a monostable multivibrator configuration 86. Once the timer 86 is triggered, its output switches from a low to high level state for a prescribed time period, as determined by the external resistor and capacitor, i.e. R.C. 88 time constant, and the time duration is set at two minutes. This timer output signal, together with the original dryer stopped logic signal, are compared using the NOR-type logic gate 92. This NOR-gate output signal switches from low to high, only if the dryer 16 has remained stopped longer than the two minute period, and then this NOR-gate 92 signal activates the automatic hold logic, as shown in FIG. 6.

More specifically, regarding when the dryer length timer 50 and product row interval timer or indicator 84 will operate, a hold period is initiated once the dryer conveyor speed has been reestablished, as determined by the dryer stopped logic signal. Initially, upon starting the dryer conveyor 14, the divide by N counter 94, consisting of a type 4040 programmable counter, of the dryer length timer 50, is reset to a zero count. The decade counter 56 and pulse generator 58 combine, as a product row timer or indicator 84, to provide a product row interval pulse, which is counted in the divide by N, 4040 counter 94 of the dryer length timer 50. The counting interval N is established to provide an output from 4073 AND-gate 96, after a sufficient number of wood veneer product row counts occur, thereby establishing the dryer conveyor length travel time needed to clear away from the exit of the dryer 16 the overly dry wood veneers 12, so they will not be active in the moisture detection and speed signalling sequences, which otherwise would cause a higher speed running of the dryer conveyor 14.

Figure 6:
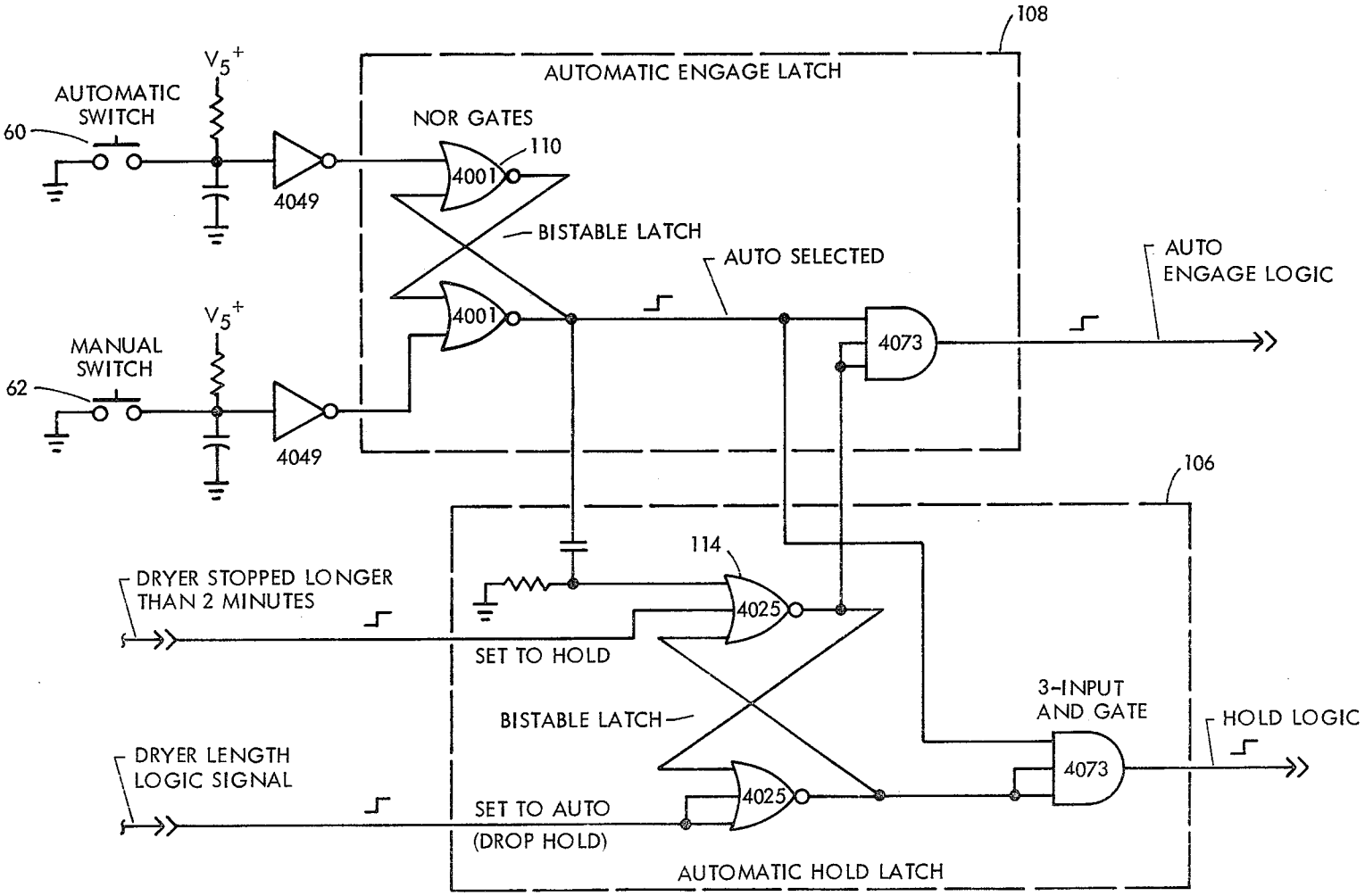

Interrelationship of Switching Functions Occurring Upon an Operator Initiating Automatic Control, and Upon Start-Up After a Production Shutdown of More than Two Minutes, Both Involving a Hold Period Before Switching to Automatic Control Operator controlled switch functions are illustrated in FIG. 6, which are initiated when an operator manipulates automatic and manual push botton type switches, 102, 104, which are both interconnected with an automatic hold latch circuit 106. This automatic hold latch circuit 100 performs two functions: it maintains a hold period, before switching to automatic control after the operator depresses the automatic switch 104; and when automatic control is engaged, it switches to hold when the dryer 16 is stopped longer than two minutes, after which it resets back to the automatic speed control mode when the hold period is terminated.

More specifically regarding these operator controlled switches 102, 104: actuation of either the manual or automatic switch, causes the automatic engage bistable latch 108 consisting of two 4001 type NOR-gates 110, to toggle to the corresponding automatic OR manual logic state. To establish automatic speed control, wherein the hold feature operates, it is necessary for the automatic switch to be actuated, thereby setting the output of the automatic engage latch 106 to the automatic selected logic state. Then when automatic operation is selected, the output signal of the automatic engage bistable latch 108 changes from a low to high logic state, and immediately sets the output of the automatic hold bistable latch 112, consisting of two 4025 type NOR-gates 114, to the hold state. In this condition, when automatic operation is selected and the hold latch 112 is set to the hold state, the dryer conveyor speed is held fixed by the sample and hold type motor control 22 until the dryer length logic signal resets the latch 112, thus dropping the hold logic signal, thereby allowing the motor control to become actively responsive to the automatic speed control monitoring computer apparatus 32.

More specifically regarding the operation of the automatic hold latch 108, when automatic control is engaged and dryer speed is automatically being controlled, then the automatic hold latch 106 will be toggled to the hold state whenever the dryer 16 is thereafter stopped longer than two minutes, and the hold logic signal is created. This then establishes the hold condition, as described before, and requires the creation of the dryer length logic signal in order to reset this latch, so the speed setting of the dryer conveyor 14 is returned to the control of the automatic speed control monitoring computer apparatus.

Figure 7:
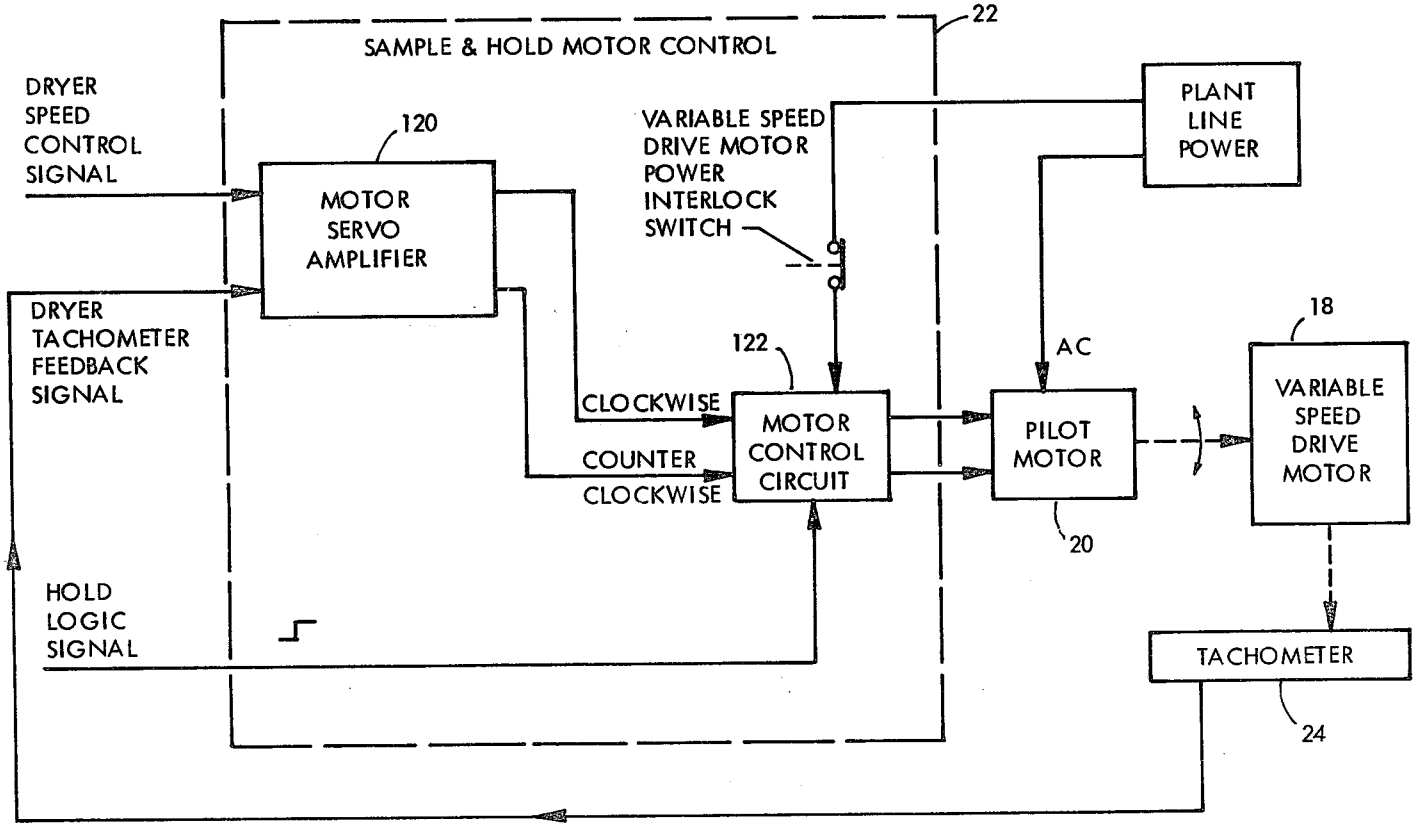
Figure 8:
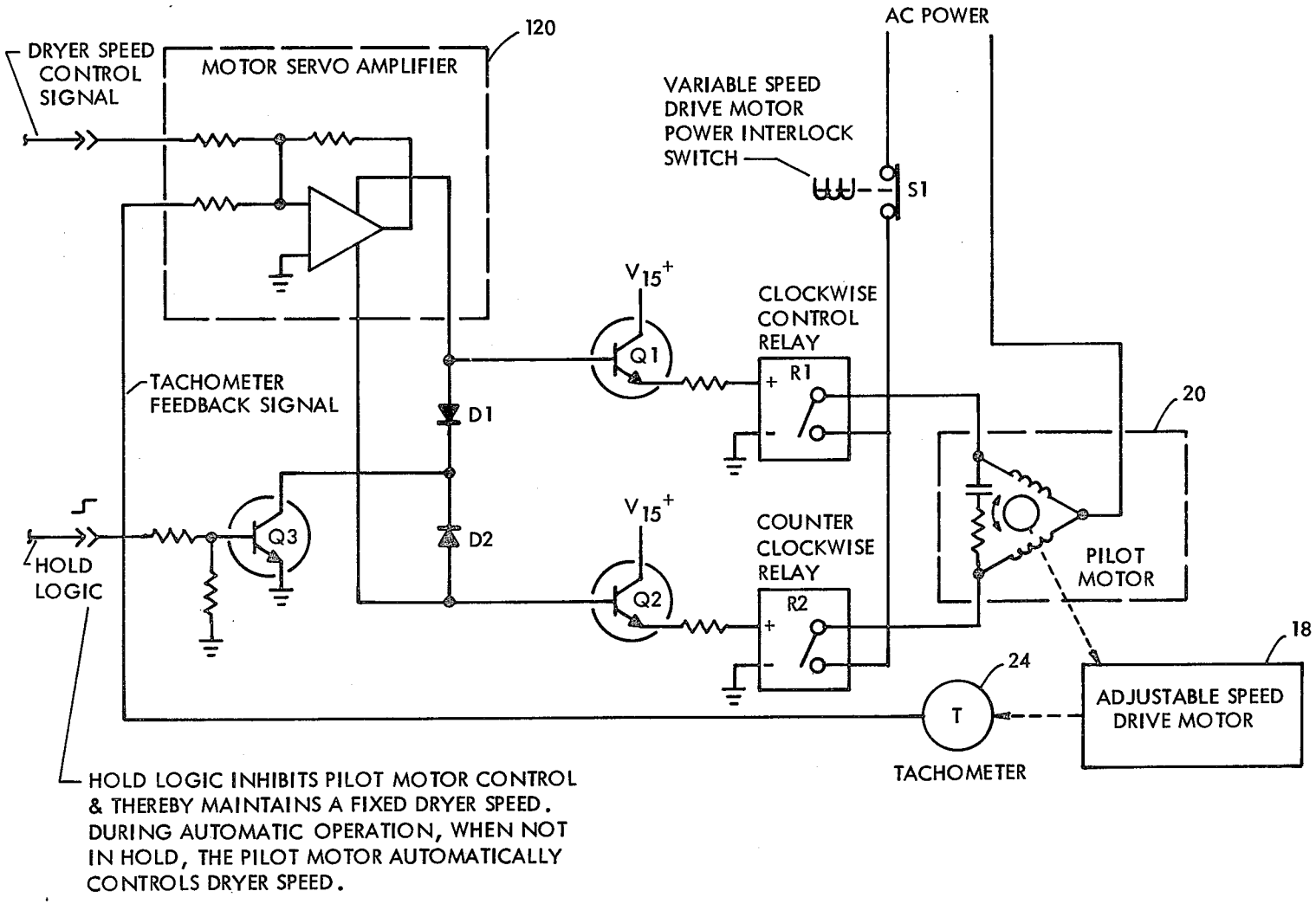

Various Circuit and Components Associated with the Sample and Hold Motor Control: The Motor Servo Amplifier and Motor Control Circuit; Together With the Pilot Motor and Related Power Interlock and Interface with the Adjustable Speed Drive Motor In FIG. 7, is a chart diagram of the operation and arrangement of the sample and hold motor control 22 with respect to its components; the motor servo amplifier 120 and motor control circuit 122, and their relationship to the pilot motor 20. Thereafter in FIG. 8 the related circuit diagrams are presented. In reference to these figures, the motor servo amplifier 120 compares and amplifiers the difference which exists between the dryer speed control signal, commonly referred to as the command signal, and the dryer speed tachometer signal, commonly referred to as the closed-loop position feedback signal. This comparative difference signa, after being amplified by the servo amplifier 120 operates switch Q1 and motor control relay R1, or switch Q2 and motor control relay R2 in such a manner as to operate the reversible pilot motor 20 in a direction to reduce this difference signal; commonly referred to as negative feedback.

More specifically regarding the motor control circuit 120: which performs the sample and hold function to disconnect motor power, and as such, prevents the pilot motor 20 from changing the variable speed drive motor setting during a hold period after a shutdown, this motor hold control occurs via the variable speed drive motor power interlock S1, which disconnects motor power, and also the hold logic switch Q3 which inhibits switches Q1 and Q2 through diodes D1 and D2. Thus, the motor control relays R1 and R2 remain deenergized, and power cannot be applied to the pilot motor 20.

When the dryer is stopped, and prior to the two minute hold logic signal, the power interlock switch S1 opens in the plywood mill AC power line to prevent erroneous speed commands from repositioning the pilot motor 20. If the two minute hold logic signal occurs and there is a shutdown, thereafter when the dryer conveyor 14 is again started, the motor control circuit 122 disconnects power to the pilot motor through relays R1 and R2, as described above to create the hold dryer speed setting, established before shutdown, for a period of time needed to clear the overly dried wood veneers from the interior of the dryer, i.e. dryer length timer period.

Figure 9:
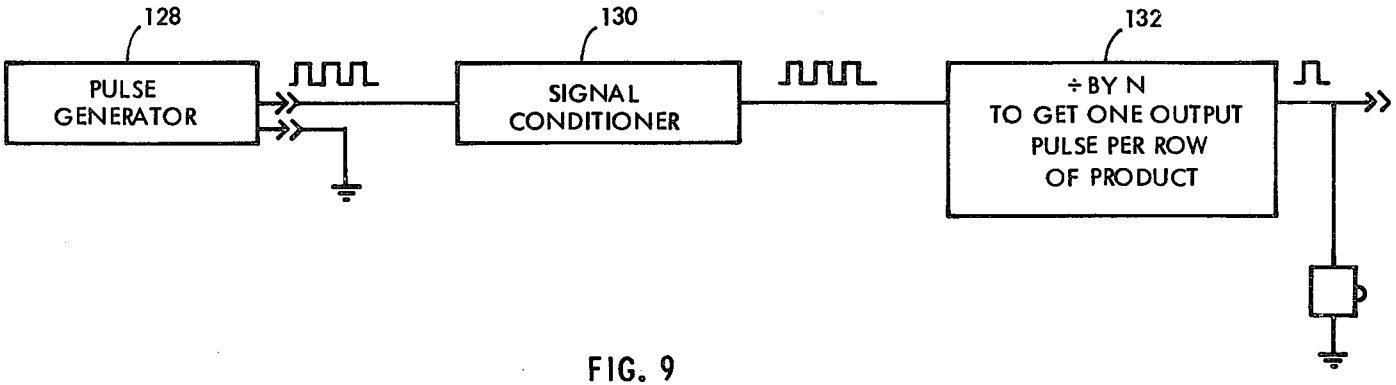

Throughout These Figures of the Drawings Essentially a Preferred Embodiment is Illustrated, However to Indicate How Other Embodiments in Whole or in Part are Made Available, Two Alternate Product Row Count Embodiments are Presented In FIG. 9 a function block diagram shows an alternate method to accomplish a product row count from the method shown in the preferred embodiment illustrated in FIG. 4. A pulse generator 128 geared either to the dryer speed conveyor 14 or variable speed drive motor 18 provides a pulsed output signal having a frequency proportional to the dryer conveyor speed. A signal conditioner 130 functions as a buffer amplifier to eliminate extraneous noise and to shape the signal pulse train. A divide by N counter 132 counts these pulses and outputs one pulse per N input pulses. As such, the divide by number, N, is programmable and set to provide one pulse for each product row count interval, i.e. one pulse for each row of wood veneer.

Figure 10:
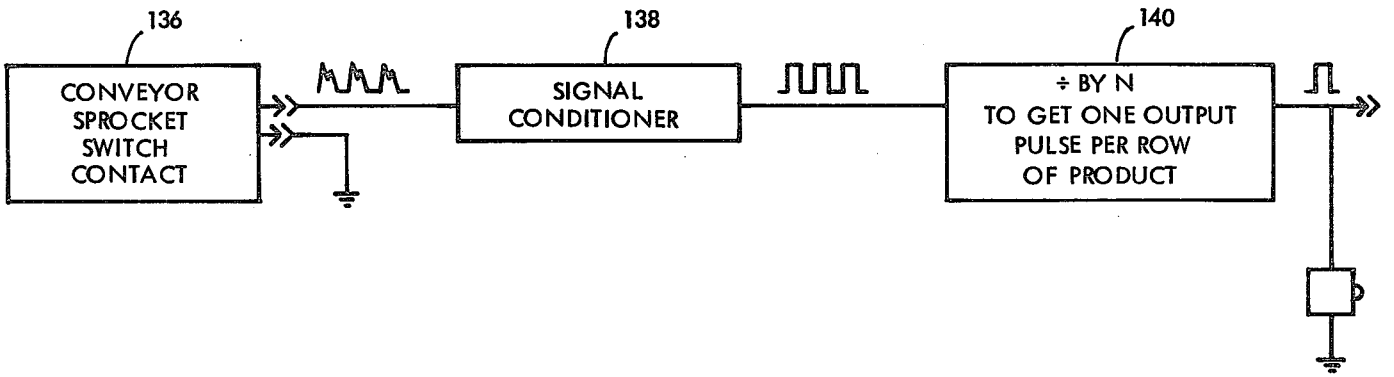

In FIG. 10 a functional block diagram shows another alternate method to accomplish a product row count from the methods illustrated in FIGS. 4 and 9. The speed of the dryer conveyor is sensed by a mechanical type switch designated as a conveyor sprocket switch 136, being driven by the rolls or gears of the dryer conveyor 14. The frequency or time interval of switch closure is proportional to dryer conveyor speed and as such can be eventually counted to determine the length of time the product 12 is moving through the dryer 16.

This signal conditioner 138 functions as a buffer amplifier to eliminate extraneous noise and to shape the signal pulse train. A divide by N counter 140 counts these pulses and outputs one pulse per N input pulses. As such, the divide by number, N, is programmable and set to provide one pulse for each product row count interval, i.e. one pulse for a row of wood veneers.

We claim:

1. A method of holding speed settings of a conveyor of a wood veneer dryer, when conveying wood veneers being dried, when being controlled by an automatic conveyor speed control monitoring computer apparatus, comprising:

(a) determining automatically when the conveyor of the wood veneer dryer has stopped by previously observing signals being generated by the motion of the conveyor;

(b) determining automatically the conveyor of the wood veneer has been stopped for a full predetermined initial shutdown period;

(c) holding the speed settings of the conveyor of the wood veneer dryer, if the dryer remains shut down throughout the initial predetermined period, until at least a wood veneer row count has occurred of the wood veneers leaving the dryer to determine that a length of the conveyor supporting the wood veneers overdried within the dryer, has been moved out of the conveyor, when dryer operations have again been resumed.

2. A hold speed setting control apparatus for addition to or inclusion in automatic speed control monitoring computer apparatus, which in turn regulates the speed setting of a conveyor of a wood veneer dryer comprising:

(a) a means to receive pulses from a conveyor speed indicating means;

(b) a means to sense the stopping of the pulses being received from a conveyor speed indicating means and to signal the start of a means to time;

(c) a means to time an initial time period during which no attempt is made to hold a conveyor speed setting and if the initial time is exceeded, to signal the need for holding a conveyor speed setting of the wood veneer dryer;

(d) a means to determine how long the conveyor speed setting will be held after starting a conveyor following the shutdown of the wood veneer dryer with the holding period preferably at least extending until the overdried wood veneers on the stopped conveyor length within the wood veneer dryer are moved out of the dryer, and thereafter to return the control of the continuous drying process equipment to the automatic speed control monitoring computer apparatus.

3. A hold speed setting control apparatus, as claimed in claim 2, wherein the means to sense the stopping of the pulses being received from a conveyor speed indicating means and to signal the start of a means to time, comprises:

(a) bridge rectifier to create a direct current analog signal;

(b) a combined amplifier and filter to prepare the direct current analog signal for subsequent conversion; and (c) a voltage to frequency converter to convert the direct current analog signal into a shaped digital pulse, utilizing a voltage controlled oscillator and a pulse generator.

4. A hold speed setting control apparatus, as claimed in claim 2, wherein the means to time an initial time period, comprises:

(a) monostable multivibrator, and a (b) NOR-gate, working with the monostable multivibrator to complete a dryer stopped logic signal.

5. A hold speed setting control apparatus, as claimed in claim 2, wherein the means to determine how long the conveyor speed setting will be held after starting a conveyor following the shutdown of the wood veneer dryer comprises:

(a) a product row interval observation means to create pulses in counting rows of products, using a decade counter and a pulse generator, and (b) a dryer length calculation means to receive pulses indicating rows of products and count them to determine the length of the dryer conveyor to be exited from the dryer with overly dried wood veneers, using a programmable divide by N counter, and an AND type logic gate.

6. A hold speed setting control apparatus, as claimed in claim 2, having in addition, a controlled switching means to activate the automatic speed control monitoring computer apparatus, to assist in the automatic actuation of the hold speed condtol apparatus, and to create an overriding manual control.

7. A hold speed setting control apparatus, as claimed in claim 6, having in addition, a sample and hold motor control to receive signals being cleared by the controlled switching means comprising in turn a motor servo amplifier, a power interlock switch, and a motor control circuit to keep the pilot motor inoperable during the hold speed setting time and thereafter return the pilot motor to the control of the automatic speed control monitoring computer apparatus.

* * * * *